US007525445B2

(12) United States Patent
DeLuca et al.

(10) Patent No.: US 7,525,445 B2
(45) **Date of Patent: *Apr. 28, 2009**

(54) LIFE SAFETY ALARM WITH A SEALED BATTERY POWER SUPPLY

(75) Inventors: Joseph G. DeLuca, Colorado Springs, CO (US); Jason M. Sharpe, Colorado Springs, CO (US)

(73) Assignee: Walter Kidde Portable Equipment, Inc., Mebane, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/532,010

(22) Filed: Sep. 14, 2006

(65) Prior Publication Data

US 2007/0069904 A1 Mar. 29, 2007

Related U.S. Application Data

(63) Continuation of application No. 10/916,922, filed on Aug. 12, 2004, now Pat. No. 7,123,158.

(60) Provisional application No. 60/499,245, filed on Aug. 29, 2003.

(51) Int. Cl.
*G08B 23/00* (2006.01)

(52) U.S. Cl. ..... 340/693.1; 340/693.5; 340/693.7; 340/693.9; 340/693.12; 361/679

(58) Field of Classification Search ..... 340/628, 340/693.1, 693.5, 693.7, 693.9, 693.12; 361/601, 679

See application file for complete search history.

(56) References Cited

U.S. PATENT DOCUMENTS

| | | | |
|---|---|---|---|
| 2,985,741 | A | 5/1961 | Ellmann |
| 4,092,641 | A | 5/1978 | Bellinghausen et al. |
| 4,313,110 | A | 1/1982 | Subulak et al. |
| 4,389,635 | A | 6/1983 | Gallagher |
| 4,553,252 | A | 11/1985 | Egendorf |
| 4,688,021 | A | 8/1987 | Buck et al. |
| 4,829,283 | A | 5/1989 | Spang et al. |
| 4,870,395 | A | 9/1989 | Belano |
| 4,901,056 | A | 2/1990 | Bellavia et al. |
| 5,028,911 | A | 7/1991 | Wanat et al. |
| 5,055,830 | A | 10/1991 | Cousins et al. |
| 5,103,216 | A | 4/1992 | Sisselman |
| 5,272,292 | A | 12/1993 | Aubert |

(Continued)

FOREIGN PATENT DOCUMENTS

| | | |
|---|---|---|
| EP | 0 714 158 A2 | 5/1996 |

*Primary Examiner*—Benjamin C Lee
*Assistant Examiner*—Travis R Hunnings
(74) *Attorney, Agent, or Firm*—Merchant & Gould P.C.

(57) ABSTRACT

A life safety alarm, for example a smoke alarm, that is battery powered, has an extended life, and is less prone to user mistakes. The batteries are sealed inside the alarm portion so that the batteries cannot be accessed by the user. As a result, the batteries are not replaceable. Rather, the alarm portion is replaced at the end of the alarm life, for example after expiration of a predetermined time period, such as ten years. The alarm is designed to be automatically activated upon initial attachment of the alarm portion to the bracket. The alarm can be manually deactivated, but once deactivated, the alarm cannot be reactivated and the alarm portion cannot be reattached to the bracket.

17 Claims, 8 Drawing Sheets

U.S. PATENT DOCUMENTS 5,359,168 A 10/1994 Cunningham
5,444,434 A 8/1995 Serby
5,578,996 A * 11/1996 Watson et al. ..... 340/628
5,612,678 A 3/1997 Shibata
5,682,131 A 10/1997 Gow
5,793,295 A 8/1998 Goldstein
5,939,994 A 8/1999 Meier et al.
6,160,487 A 12/2000 DeLuca
6,297,745 B1 * 10/2001 Meier ..... 340/693.11
6,433,700 B1 8/2002 Malewski et al.
7,123,158 B2 * 10/2006 Deluca et al. ..... 340/693.1
2002/0097162 A1 7/2002 Chambers

* cited by examiner

LIFE SAFETY ALARM WITH A SEALED BATTERY POWER SUPPLY

RELATED APPLICATION

This application is a continuation of U.S. Non-Provisional application Ser. No. 10/916,922, filed on Aug. 12, 2004, which claimed benefit of U.S. Provisional Application Ser. No. 60/499,245, filed on Aug. 29, 2003, the entireties of which are hereby incorporated by reference.

FIELD OF THE INVENTION

The invention relates to battery powered electronic devices. More particularly, the invention relates to battery powered electronic devices, especially life safety alarms, for example smoke alarms and carbon monoxide alarms, where the batteries are sealed inside the device to prevent access to the batteries.

BACKGROUND OF THE INVENTION

Electronic devices that are powered by one or more batteries are well known. These devices are often designed to permit installation of the batteries, as well as replacement of the batteries as needed.

In certain battery powered electronic devices it is especially important that the batteries be properly installed and that the batteries have sufficient power for proper operation of the device. One example of such an electronic device is a battery powered life safety alarm. Life safety alarms that detect potential life-threatening conditions and generate a warning signal are well known. Examples of such alarms includes smoke alarms, flame detectors, carbon monoxide alarms, and other life safety alarms that detect a potential life threatening condition and provide a warning signal to warn of the possible life threatening condition.

The batteries in many battery powered life safety alarm are often replaceable so that when the battery power is sufficiently depleted, the user can remove the depleted batteries and install fresh batteries. One consequence of having replaceable batteries is that the user must periodically access the alarm and change the batteries. When the alarm is mounted high on a ceiling or is located in a relatively inaccessible location, battery replacement can be difficult.

Battery replacement can present other challenges as well. The user may inadvertently install new batteries that are depleted such that they have insufficient power for proper alarm operation. Further, the new batteries may be improperly installed or not installed at all. If any of these mistakes occur, the alarm will not function, or will not function properly, which is highly dangerous.

Some battery operated alarms are designed so that the batteries are not replaceable. Some of these alarm designs permit the user to deactivate the alarm and to subsequently reactivate the alarm after it has been deactivated. This deactivation and activation can occur as many times as the user desires. Further, some of these alarm designs require the user to manually activate the alarm before the alarm can be attached to the mounting bracket.

There is a need for a smoke alarm or other life safety alarm having an extended life, and which is less prone to user mistakes or improper use during installation as well as during the life of the alarm.

SUMMARY OF THE INVENTION

The invention relates to a life safety alarm that is battery powered and has an extended life. The invention further relates to a life safety alarm that is less prone to user mistakes. The batteries are sealed inside the alarm portion whereby the batteries cannot be accessed by the user. As a result, the batteries are not replaceable. Rather, the alarm portion is replaced at the end of the alarm life, for example after expiration of a predetermined time period. Because the batteries are not replaceable, the difficulties and mistakes that accompany battery replacement are eliminated.

The alarm preferably has a long life in order to reduce the time period between alarm body replacement. For example, in the preferred embodiment, the batteries and other alarm components are intended to have a life-span of ten years. The alarm could have other life-spans as well.

In addition, the alarm is designed to automatically activate when the user attaches the alarm portion to the mounting bracket. At the end of the alarm life, the alarm will emit a signal to indicate that the alarm portion needs replacement. The user then removes the alarm portion from the mounting bracket and slides a switch on the alarm to deactivate the alarm. Deactivation of the alarm removes power from the alarm circuitry and drains remaining power from the batteries. Further, when deactivated, the alarm portion is mechanically prevented from being mounted back on the mounting bracket.

Alarm activation is automatic, and no user interaction, other than attaching the alarm portion to the mounting bracket, is necessary in order to activate the alarm. Therefore, the user cannot mistakenly forget to activate the alarm. Further, the alarm is designed so that the user can only change the alarm from an ON condition to the DEACTIVATED condition. Once in the DEACTIVATED condition, the alarm cannot be changed back to the ON condition without breaking the alarm. However, even if the alarm is changed back to the ON condition after being deactivated, the alarm is designed to prevent reattachment of the alarm portion to the mounting bracket.

The concepts described herein can be utilized on numerous life safety alarms. Examples of life safety alarms to which the concepts described herein could be applied includes smoke alarms, flame detectors, carbon monoxide alarms, and other life safety alarms that detect a potential life threatening condition and provide a warning signal to warn of the possible life threatening condition.

These and various other advantages and features of novelty which characterize the invention are pointed out with particularity in the claims annexed hereto and forming a part hereof However, for a better understanding of the invention, its advantages and objects obtained by its use, reference should be made to the drawings which form a further part hereof, and to the accompanying description, in which there is described a preferred embodiment of the invention.

DESCRIPTION OF THE DRAWINGS

These and other features of the invention will now be described with reference to the drawings of preferred embodiments, which are intended to illustrate and not to limit the invention and in which.

DETAILED DESCRIPTION OF THE INVENTION

The invention relates to a battery powered electronic device in which the batteries are sealed within the device to prevent access to the batteries by the user, whereby the batteries are not intended to be replaceable. For convenience, the inventive concepts will be described herein with respect to a life safety alarm, in particular a smoke alarm. However, it is to be realized that the inventive concepts could be applied equally as well to other life safety devices, for example a carbon monoxide alarm or a flame detector. In addition, for convenience, the smoke alarm will be described herein as having a plurality of batteries. However, it is to be realized that the inventive concepts described herein could be utilized in alarms having a single battery.

In general, the electronic device according to the invention includes a first portion, and a second portion configured for attachment to the first portion. The second portion includes electronics to operate the device and at least one battery for powering the electronics. Further, cooperating features on the first portion and the second portion automatically activate the second portion upon initial attachment of the second portion to the first portion. When activated, the device is able to function and operate as intended by the design of the device.

The device can also include a manual deactivation mechanism to permit manual deactivation of the second portion after the second portion has been activated and preventing reactivation once the second portion is deactivated. When deactivated, the device is no longer functional. Moreover, when deactivated, the second portion is prevented from being reactivated and from being reattached to the first portion.

Figure 1:
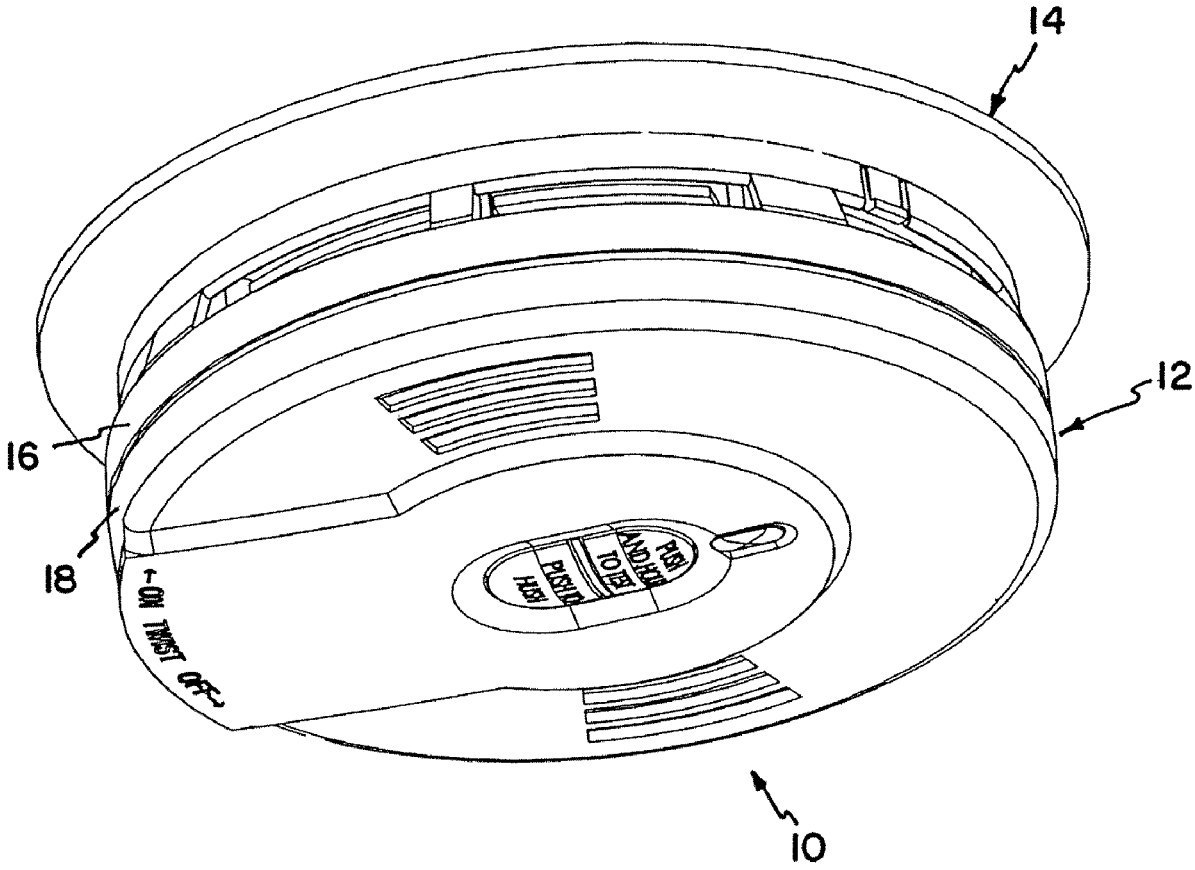
FIG. 1 is a view of a perspective view of a smoke alarm according to the present invention.

With reference to FIG. 1 and the other figures, a specific implementation of the inventive concepts according to the invention will be described in relation to a smoke alarm 10. The alarm 10 includes an alarm portion 12 which in use will house the smoke detection system, alarm electronics, and the batteries necessary for operation of the alarm 10. The specifics of the smoke detection system and the alarm electronics are not necessary for a proper understanding of the inventive concepts. Suitable smoke detection systems and alarm electronics for use in the alarm 10, as well as the operation of a smoke alarm, would be known to those of skill in the art having read this specification. The alarm 10 further includes a mounting bracket 14 which in use is fixed to, for example, a ceiling (not shown) and to which the alarm portion 12 is attached.

With continued reference to FIG. 1, the alarm portion 12 includes a top enclosure 16 and a bottom enclosure 18 that is connected to the top enclosure 16. When connected to each other, the top enclosure 16 and the bottom enclosure 18 enclose the smoke detection system, the alarm electronics, the batteries and other components of the alarm portion including the activate/deactivate system to be later described. As used herein, the terms "top", "bottom" and the like, are in reference to the smoke alarm in use as it is mounted on a ceiling of a building. Therefore, the top enclosure 16 is generally closer to the ceiling than is the bottom enclosure 18, and the bottom enclosure 18 is the portion of the alarm that, in use, will face downward toward the floor of the building.

Figure 2:
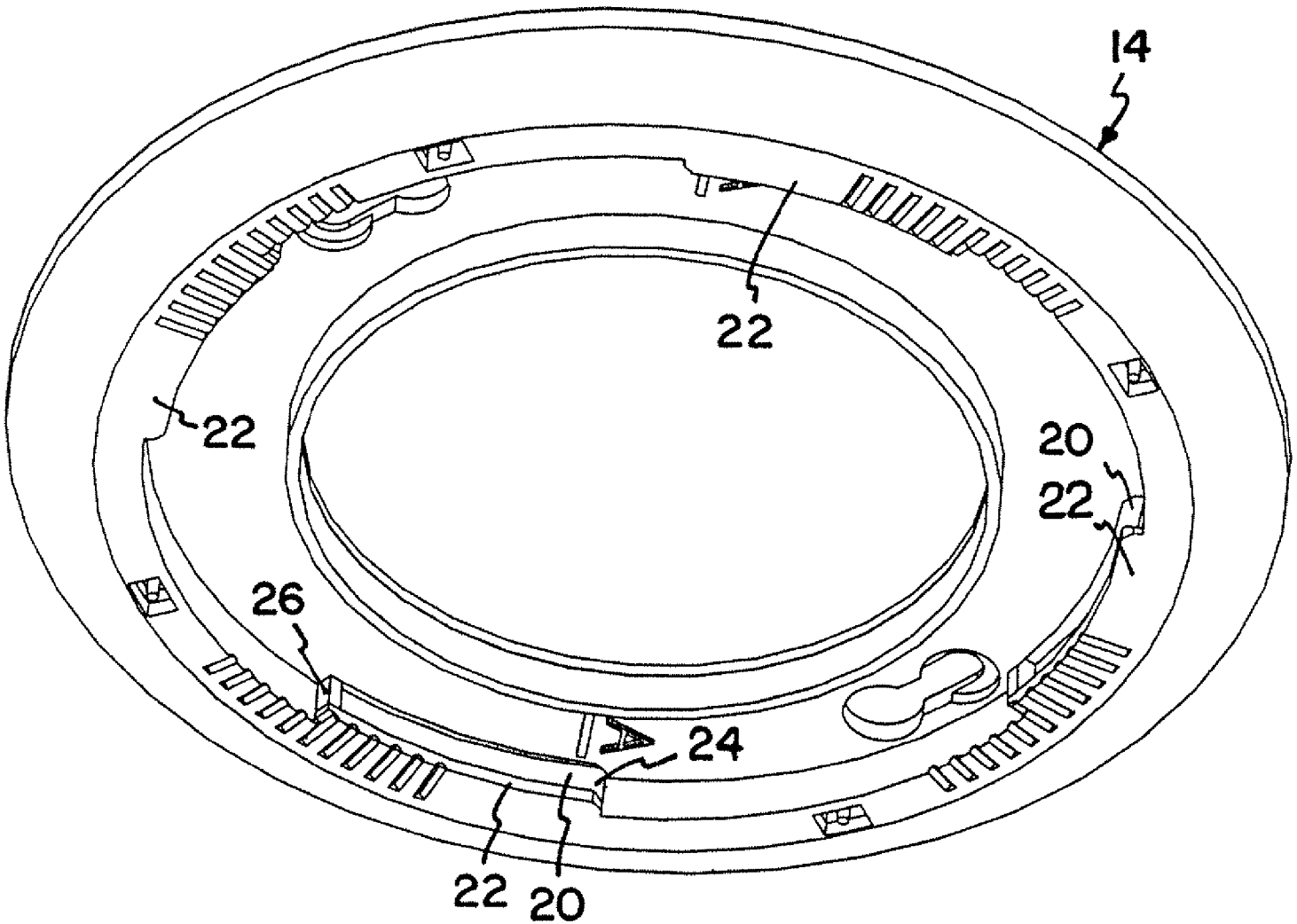
FIG. 2 is a view of the mounting bracket of the smoke alarm with the alarm portion removed.
Figure 3:
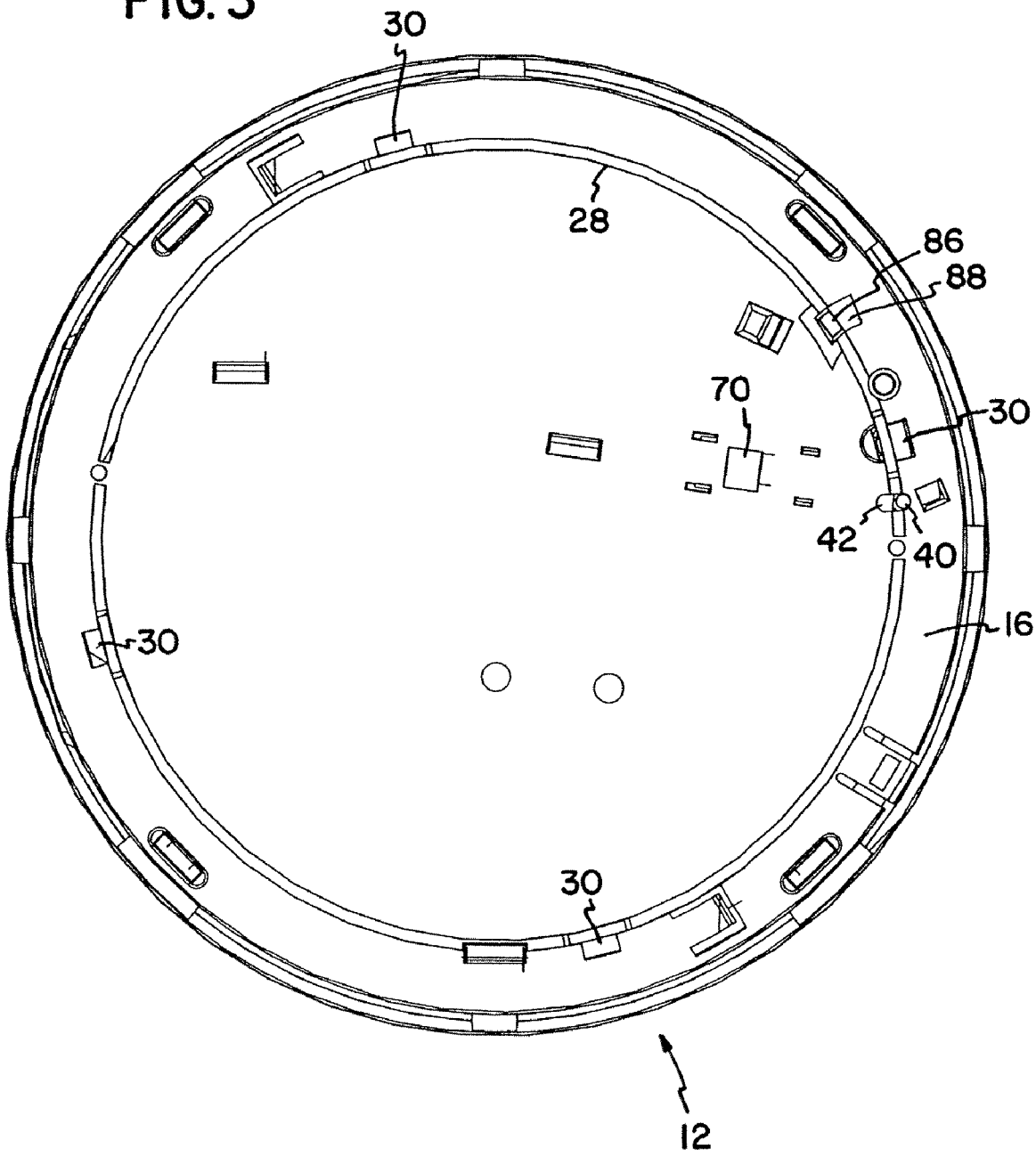
FIG. 3 is a view of the top side (i.e. the side that faces the mounting bracket) of the alarm portion.

The alarm portion 12 is designed to be detachably connected to the mounting bracket 14. In the illustrated embodiment, the portion 12 is connected to the bracket 14 via a twist on/twist off connection system of a type that is well known in smoke alarms. Details of the connection system will be described with reference to FIGS. 2 and 3. As shown in FIG. 2, the bracket 14 includes four circumferentially spaced grooves or channels 20 each of which is defined in part by a flange 22. One end 24 of each channel 20 is open and the opposite end is closed by a stop 26. Turning to FIG. 3, the upper surface of the top enclosure 16 includes an upstanding circular flange 28 with four equally spaced tabs 30 projecting outwardly from the flange 28. The tabs 30 are designed to fit within the channels 20 to secure the alarm portion 12 to the bracket 14. When the alarm portion 12 is brought toward the bracket 14 in the proper orientation, and the portion 12 is rotated in the proper direction, the tabs 30 enter the open ends 24 of the channels 20, with the flanges 22 retaining the tabs 30 in the channels 20. Rotation continues until the tabs 30 contact the stops 26, at which time the portion 12 is securely attached to the bracket 14.

The alarm portion 12 is powered by one or more batteries 32 that are disposed therein. In the illustrated embodiment, the alarm 10 includes three CR 2/3 type batteries 32 that are available from FDK America Inc., of San Jose, Calif. A larger or smaller number of batteries, as well as different battery types, could be used. The batteries 32 are sealed within the alarm portion 12 and are not intended to be replaceable. By "sealed" Applicant means that the batteries cannot normally be accessed by the user absent the user breaking or destructing some portion of the alarm portion 12. At the end of the alarm life, the alarm portion 12 will emit a signal, for example an audible "chirp", to indicate that the alarm portion 12 needs replacement. At that time, the user removes the alarm portion 12 from the bracket 14 and installs a new alarm portion. Alarm life is preferably measured by the expiration of a predetermined time period, for example ten years. Therefore, the batteries preferably have enough power to operate the alarm for the entire alarm life, for example up to ten years.

To simplify alarm operation, the alarm 10 is designed to automatically activate when the alarm portion 12 is attached to the bracket 14. Further, at the end of the alarm life, or prior to that time if desired, the user can deactivate the alarm. The activation and deactivation of the alarm 10 is controlled by an activate/deactivate system 33, which is best seen in FIGS. 3-8.

Figure 5:
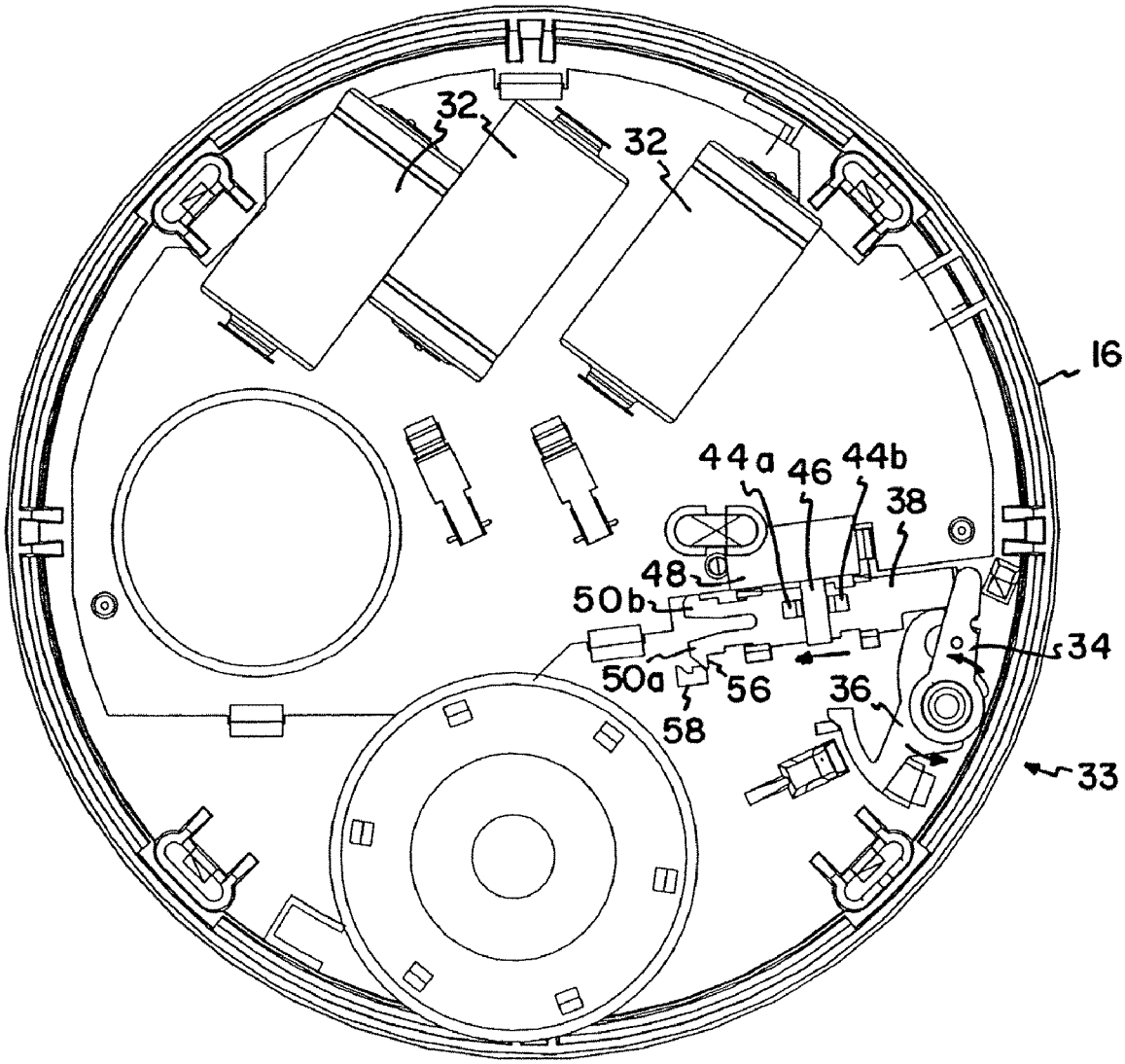
FIG. 5 is a view of the interior of the alarm portion with the bottom enclosure removed and looking upward toward the alarm portion as it would be mounted on the mounting bracket.

Referring initially to FIG. 5, the system 33 includes a rotate activate component 34 which forms a portion of an activation mechanism, a rotate deactivate component 36 which forms a portion of a manual, permanent deactivation mechanism, and an activate/deactivate slider 38 which is part of both the activation mechanism and the deactivation mechanism. The components 34, 36, 38 are shown in FIG. 5 in their preactivated or shipping positions. The activate component 34 is designed to rotate in a counterclockwise direction, as shown by the arrow in FIG. 5, upon attachment of the base 12 to the bracket 14. Rotation of the component 34 actuates the slider 38 so that it slides to the left in FIG. 5 to an activated or ON position (shown in FIGS. 7A and 7B). During this initial movement of the slider 38, the component 36 does not rotate. Further movement of the slider 38 to the left in FIG. 5, which is caused manually by the user, places the slider 38 in the DEACTIVATED position (shown in FIGS. 8A and 8B). At the same time, the slider 38 engages the component 36 causing the component 36 to rotate counterclockwise to a locked position (shown in FIGS. 8A and 8B).

Figure 4:
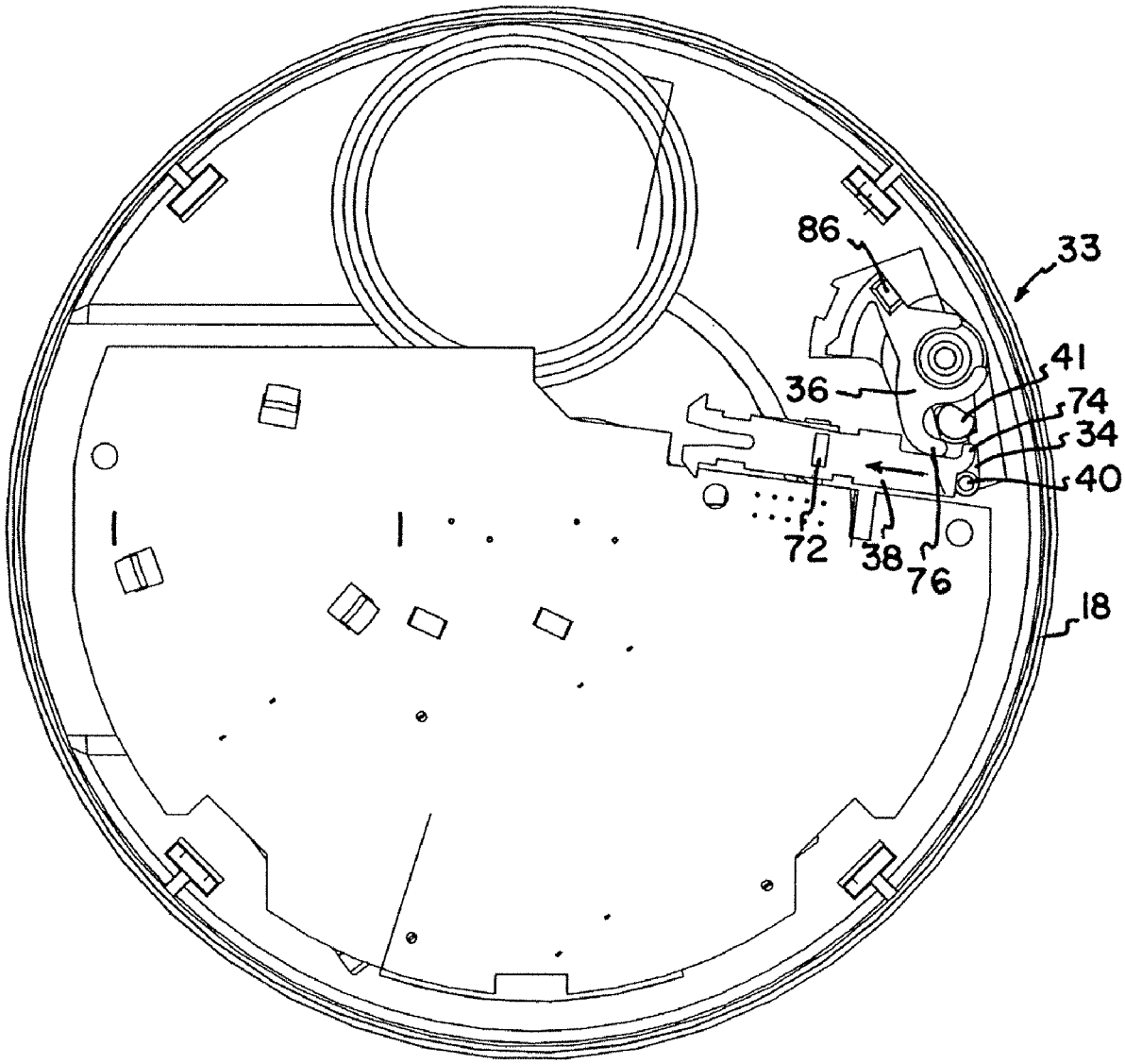
FIG. 4 is a view similar to FIG. 3, but with the top enclosure removed to illustrate components of the activate/deactivate system.
Figure 9:
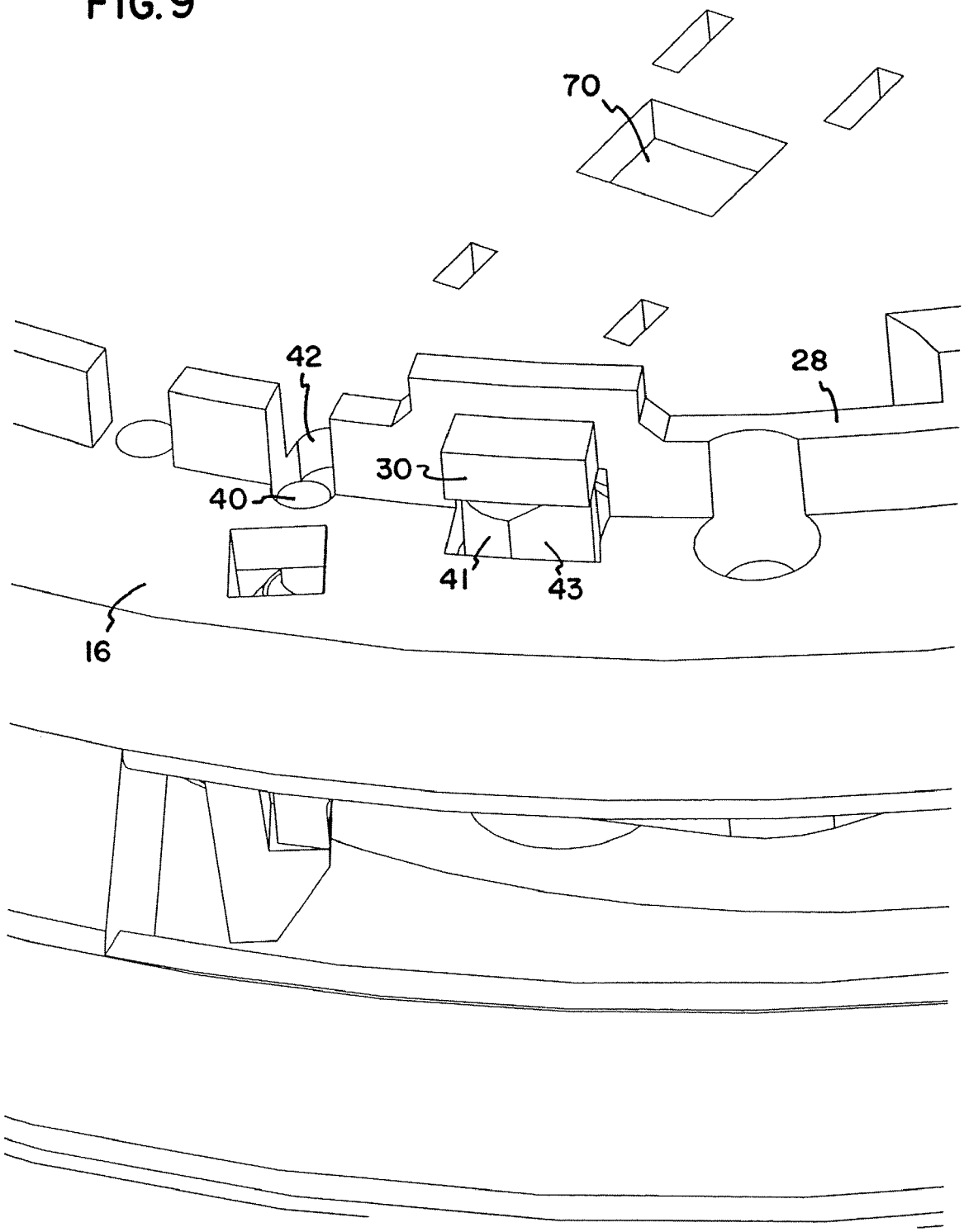
FIG. 9 is a detailed view of a portion of the activate/deactivate system.

With reference to FIGS. 3, 4, and 9, the activate component 34 includes a boss 40 that is disposed within a hole 42 in the top of the top enclosure 16. In the preactivated position shown in FIG. 3, the boss 40 is positioned slightly outside the circumference of the flange 28 on the enclosure 16. The activate component 34 further includes an actuating boss 41 that has a "D"-shaped cross-section with a flat side 43. As shown in FIG. 9, the boss 41 projects past the top surface of the top enclosure 16, with the flat side 43 of the boss 41 facing generally radially outwardly.

When the alarm portion 12 is attached to the bracket 14, the flat side 43 of the boss 41 is engaged by a portion of one of the flanges 22 which actuates the boss 41 inward closer to the circumference of the flange 28. As shown in FIG. 4, the boss 40 is engaged with the end of the slider 38, so that the movement of the boss 41 causes rotation of the activate component 34, which in turn causes the sliding movement of the slider 38 to the ON position.

Returning to FIG. 5, the slider 38 includes a pair of bosses 44*a*, 44*b* that project therefrom. A switch actuating tab 46 is disposed between the bosses 44*a*, 44*b*, with the tab 46 being connected to an electronic switch 48 associated with the alarm electronics. Movement of the slider 38, which is caused by the boss 40, results in movement of the tab 46 which in turn actuates the switch 48. Actuation of the switch 48 activates the alarm. In this manner, attachment of the alarm portion 12 to the bracket 14, which actuates the boss 40 which in turn actuates the slider 38, automatically activates the alarm.

As seen in FIGS. 5-8, the end of the slider 38 opposite the end engaged by the boss 40 is formed into a pair of resilient arms 50*a*, 50*b*. Each arm 50*a*, 50*b* includes a lock tab 52 having a sloped surface 54 at the front and a lock surface 56 at the rear. The tabs 52 cooperate with lock bosses 58 (only one boss 58 is visible in FIGS. 5-8) which define the ON and DEACTIVATED positions of the slider 38. Each boss 58 comprises a first sloped surface 60 at the front end, a recess 62 at the central portion, a second sloped surface 64, and a rear surface 66.

Figure 6A:
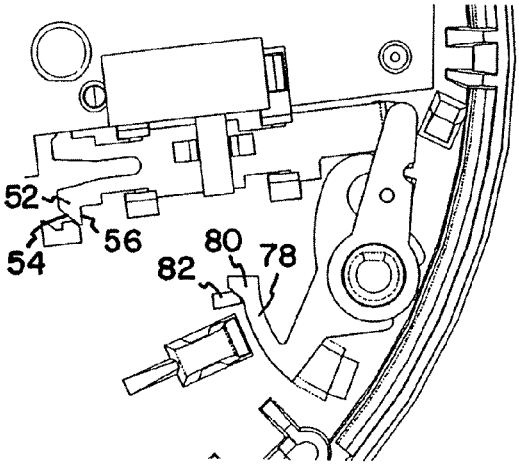
FIGS. 6A and 6B illustrate the components of the activate/deactivate system in a preactivated position.
Figure 6B:
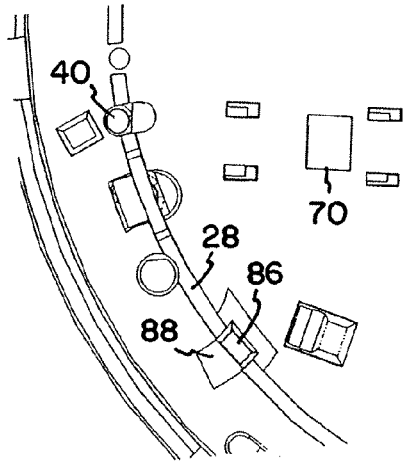
Figure 7A:
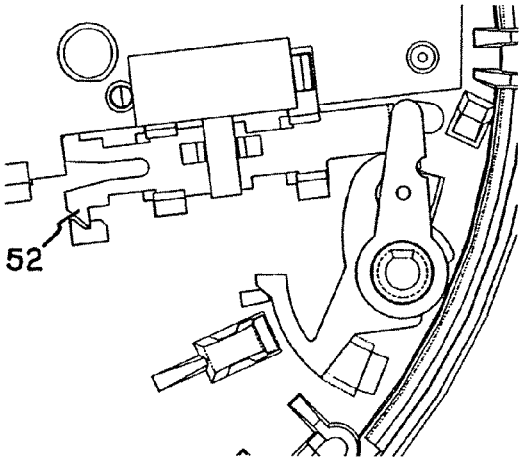
FIGS. 7A and 7B illustrate the components of the activate/deactivate system in an activated or ON position.
Figure 7B:
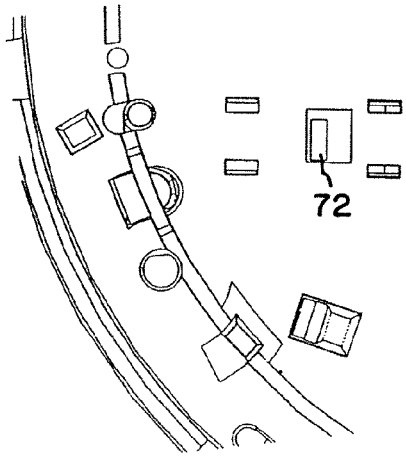

It is preferred that the slider 38 be designed for one-way movement only. In the preactivated position of the slider 38, the sloped surfaces 54 of the tabs 52 are engaged with the sloped surfaces 60 of the bosses 58, as shown in FIGS. 6A and 6B. As the slider 38 is actuated by the boss 40, the resilient arms 50*a*, 50*b* flex inwardly as a result of the sloped surfaces 54, 60 until the tabs 52 drop into the recesses 62, as shown in FIGS. 7A and 7B. This defines the ON position of the slider 38. Engagement between the lock surfaces 56 of the bosses 58 and the vertical wall of the recesses 62 prevents movement of the slider 38 back to the preactivated position.

Figure 10:
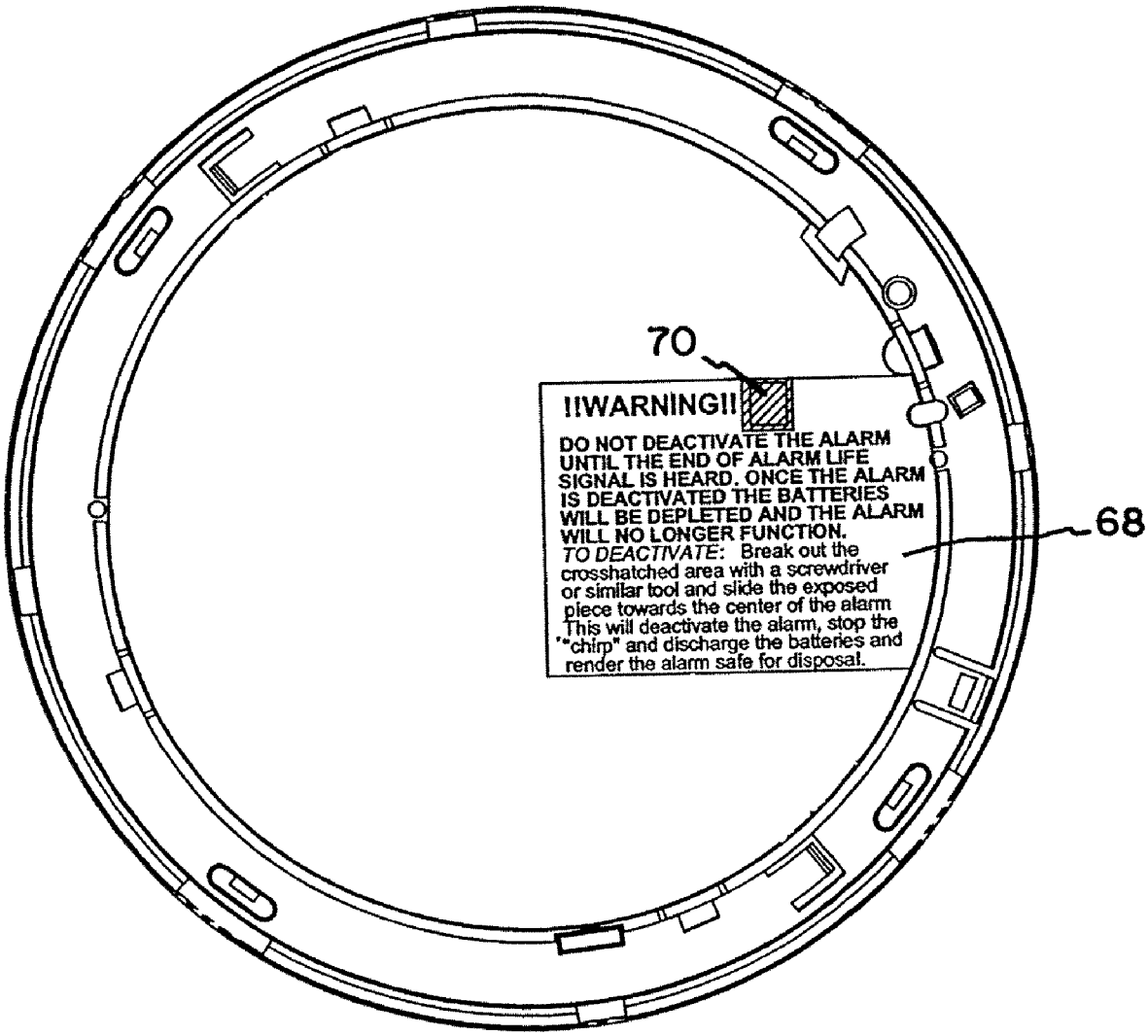
FIG. 10 illustrates a label that covers the hole in the top of the upper enclosure to control access to the deactivate portion of the activate/deactivate system.

At the ON position, the alarm 10 is activated and operates for a predetermined period of time, for example 10 years. To deactivate the alarm, the user must break out a section of a product label 68, a portion of which is shown in FIG. 10, that covers a hole 70 in the top of the top enclosure 16. The hole 70 permits access to the top of the slider 38 which includes a slot 72 formed therein. This is the only access the user has to the slider 38. It is to be noted that this access to the slider 38 is only permissible when the alarm portion 12 is detached from the bracket 14.

Prior to activation, the slot 72 is not accessible in the hole 70. However, when the slider 38 is at the ON position, the slot 72 is positioned in the hole 70 so that it can be accessed by the user, as shown in FIG. 7B, once the section of the product label is broken out. Using a tool, such as the tip of a screwdriver, engaged in the slot 72, the user is able to slide the slider 38 to the DEACTIVATED position shown in FIG. 8A. This movement of the slider 38 deactivates the switch 48 which deactivates the alarm 10. At the DEACTIVATED position, the engagement between the lock surfaces 56 and the rear surfaces 66 of the bosses 58 prevents movement of the slider 38 back to the ON position to prevent reactivation of the alarm portion. In addition, when the switch 48 is deactivated, a circuit in the alarm portion automatically drains remaining power from the batteries.

As shown in FIG. 4, the end of the slider 38 includes a tab 74. In addition, the rotate deactivate component 36 includes a tab 76. At the preactivated position of the slider 38, there is a gap between the tab 74 and the tab 76 so that the movement of the slider 38 to the ON position does not cause movement of the rotate deactivate component 36. However, at the ON position, the tabs 74, 76 are engaged, and the movement of the slider 38 to the DEACTIVATED position causes the rotate deactivate component 36 to rotate counterclockwise to a locked position.

Figure 8A:
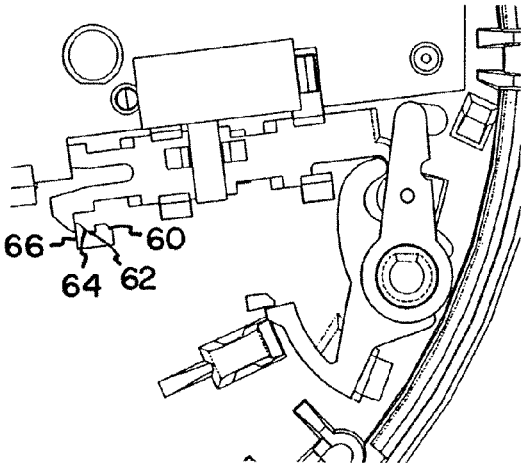
FIGS. 8A and 8B illustrate the components of the activate/deactivate system in a DEACTIVATED position.
Figure 8B:
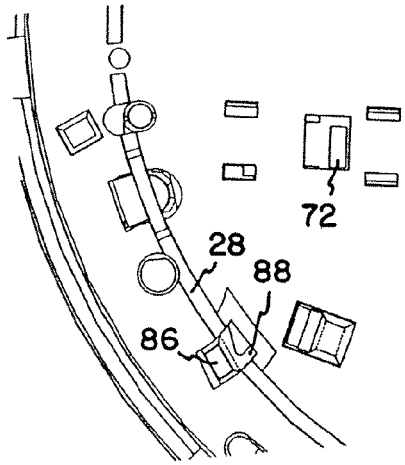

With reference to FIG. 6A, the rotate deactivate component 36 includes a resilient arm 78 with an enlarged end 80. The end 80 is engaged with a boss 82. The rotate deactivate component 36 further includes a tab 86 that projects upwardly through a hole 88 in the top of the top enclosure 16. At the initial position of the rotate deactivate component 36, the tab 86 is aligned with the flange 28 of the top enclosure 16 as shown in FIGS. 3, 6B and 7B. As the rotate deactivate component 36 is rotated by the slider 38 to the locked position, the arm 78 flexes to enable the end 80 to move past the boss 82 and snap into place behind the boss 82, as shown in FIG. 8A. At the same time, the tab 86 moves outwardly beyond the circumference of the flange 28, as shown in FIG. 8B.

With the end 80 positioned behind the boss 82, the rotate deactivate component 36 is prevented from being actuated clockwise back to its initial unlocked position. Further, with the tab 86 positioned beyond the circumference of the flange 28, the alarm portion 12 is prevented from being reattached to the bracket 14. As a result, when deactivated, the alarm portion cannot be reattached to the bracket. Further, the user is unable to actuate the rotate deactivate component 36 out of the locked position.

With the alarm 10, activation is automatic, which eliminates the need for user interaction in order to activate the alarm portion other than attaching the alarm portion to the bracket. Thus, the chance of a user making a mistake in activating the alarm is reduced. In addition, the alarm portion is designed so that it cannot be reactivated after it has been deactivated.

Further, if the user forces the slider 38 from the DEACTIVATED position to the ON position by breaking the one-way directional features of the slider 38, the rotate deactivate component 36 does not move and remains in place to prevent reattachment of the alarm portion to the mounting bracket. Therefore, a deactivated alarm portion cannot be installed on the bracket.

Moreover, the three operational states of the alarm 10, preactivated, activated, and deactivated, are accomplished using one, three position switch. Some current alarm designs require the use of two switches to accomplish the same three operational states. Therefore, the invention provides a more cost effective solution.

The embodiments of the inventions disclosed herein have been discussed for the purpose of familiarizing the reader with novel aspects of the invention. Although preferred embodiments have been shown and described, many changes, modifications, and substitutions may be made by one having skill in the art without necessarily departing from the spirit and scope of the invention.

What is claimed is:

1. A method of operating an electronic device, the method comprising:

powering electronics to operate the electronic device with at least one battery included in a second portion;

attaching the second portion to a first portion;

automatically activating the second portion upon the attachment of the second portion to the first portion using an activate/deactivate system; and manually deactivating the second portion after activating the second portion, such that the second portion cannot be reactivated and the second portion cannot be reattached to the first portion.

2. The method of claim 1, wherein attaching the second portion to the first portion comprises mounting an alarm portion of a life safety device to a mounting bracket of the life safety device.

3. The method of claim 1, further comprising detecting a life threatening condition after automatic activation.

4. The method of claim 3, wherein detecting a life threatening condition comprises detecting smoke.

5. The method of claim 1, wherein activating the second portion comprises adjusting a slider of the activate/deactivate system to an activated position, the slider being configured for one-way movement.

6. The method of claim 5, wherein deactivating the second portion comprises adjusting the slider to a deactivated position.

7. The method of claim 1, further comprising sealing the battery inside the second portion to prevent replacement of the battery.

8. An electronic device, comprising:

a first portion;

a second portion configured for attachment to the first portion, the second portion including electronics to operate the device and at least one battery for powering the electronics;

an activation mechanism to activate the second portion;

a permanent deactivation mechanism to permit permanent deactivation of the second portion after the second portion has been activated; and a reattachment prevention mechanism to prevent reattachment of the first and second portions once the second portion is permanently deactivated.

9. The electronic device of claim 8, wherein the electronic device is a life safety alarm, the first portion comprises a mounting bracket of the life safety alarm, and the second portion comprises an alarm portion of the life safety alarm.

10. The electronic device of claim 9, wherein the alarm portion includes a system to detect a life threatening condition.

11. The electronic device of claim 10, wherein the system comprises a smoke detection system.

12. A life safety device configured to detect smoke or carbon monoxide, comprising:

a first portion including a smoke or carbon monoxide detection system;

a second portion configured for attachment to the first portion, the second portion including electronics to operate the device and at least one battery for powering the electronics;

cooperating features on the first portion and the second portion that automatically activate the second portion upon initial attachment of the second portion to the first portion and deactivate the second portion after activation; and a component to prevent reattachment of the second portion to the first portion once the second portion is deactivated;

wherein, when deactivated, the second portion cannot be reactivated and the second portion cannot be reattached to the first portion.

13. The life safety device of claim 12, wherein the first portion comprises a mounting bracket of the life safety alarm, and the second portion comprises an alarm portion of the life safety alarm.

14. The life safety device of claim 12, wherein the cooperating features comprise an activate/deactivate system, and wherein the activate/deactivate system is configured to automatically activate the second portion upon initial attachment of the second portion to the first portion.

15. The life safety device of claim 14, wherein the activate/deactivate system is configured to enable the user to manually deactivate the second portion.

16. The life safety device of claim 14, wherein the activate/deactivate system comprises a slider configured for one-way movement and having three positions.

17. The electronic device of claim 12, wherein the battery is sealed inside the second portion, whereby the battery is not user replaceable.

* * * * *